United States Patent [19]

Engels

[11] Patent Number: 4,498,217

[45] Date of Patent: Feb. 12, 1985

[54] PILE FABRIC CUTTING DEVICE

[75] Inventor: Walter Engels, Tryon, N.C.

[73] Assignee: Milliken Research Corporation, Spartanburg, S.C.

[21] Appl. No.: 390,320

[22] Filed: Jun. 21, 1982

[51] Int. Cl.[3] ..... D06C 13/08

[52] U.S. Cl. ..... 26/9; 83/672; 83/838

[58] Field of Search ..... 26/8 C, 9, 31; 19/114; 83/838, 660, 672

[56] References Cited

U.S. PATENT DOCUMENTS

| | | | |
|---|---|---|---|
| 33,270 | 7/1861 | Spaulding | 83/838 |
| 1,811,549 | 6/1931 | Langer | 19/114 X |
| 3,527,393 | 9/1970 | Matsui et al. | 83/660 X |
| 3,662,934 | 5/1972 | Nara et al. | 83/672 X |
| 3,882,750 | 5/1975 | Duckett et al. | 83/659 |
| 3,977,055 | 8/1976 | Gilpatrick | 26/9 |
| 4,117,577 | 10/1978 | Gilpatrick | 26/9 |
| 4,394,789 | 7/1983 | Egerer | 19/114 X |

FOREIGN PATENT DOCUMENTS

| | | | |
|---|---|---|---|
| 1484526 | 5/1967 | France | 19/114 |
| 14975 | of 1887 | United Kingdom | 19/114 |
| 862026 | 3/1961 | United Kingdom | 19/114 |

*Primary Examiner*—Robert R. Mackey

*Attorney, Agent, or Firm*—Earle R. Marden; H. William Petry

[57] ABSTRACT

A rotor for cutting the loops or surface of a fabric having a plurality of segmented blades interconnected together to form a helix which when used to cut the surface of a fabric does not cause a rowing effect in the surface. The cutting blades in adjacent rows are positioned to be between two blades on any one row.

4 Claims, 7 Drawing Figures

PILE FABRIC CUTTING DEVICE

This invention relates to a fabric having a surface to which a modification is to be made and to which a substrate has to be applied in order to efficiently handle the fabric while the surface is being modified. In its specific form the invention includes a rotor with a series of cutting blades thereon which are rotated against the face of a tufted loop fabric to cut the loops thereof to provide a cut pile fabric. This application specifically is directed to the helical segmented cutting rotor construction used to cut the pile loops.

Therefore, it is an object of the invention to provide a new and novel cutting rotor to cut the loops of a loop pile fabric to provide a cut pile fabric which does not have a rowing effect therein.

Other objects and advantages of the invention will become readily apparent as the specification proceeds to describe the invention with reference to the accompanying drawings, in which.

Figure 1:
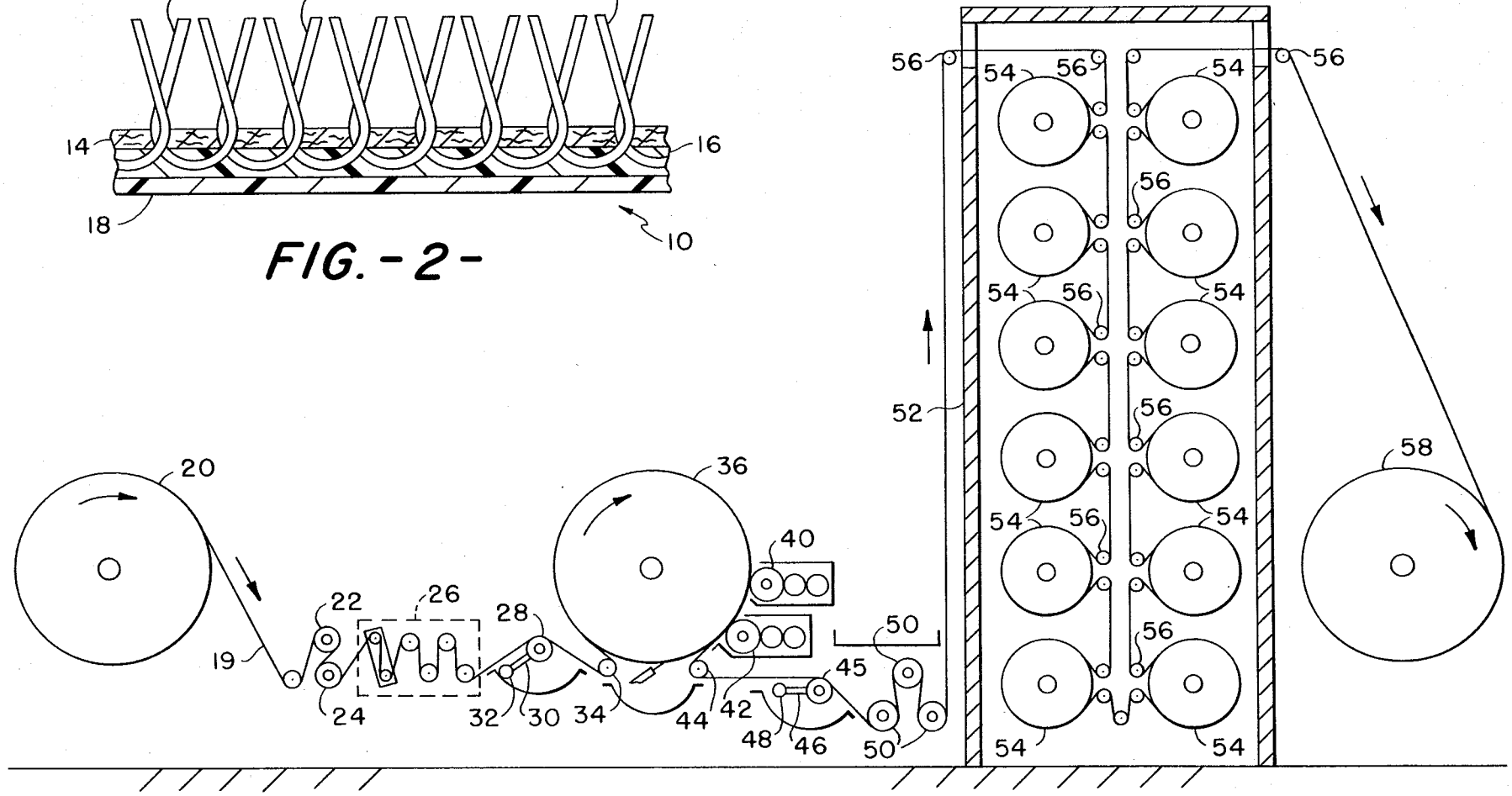
FIG. 1 is an overall schematic representation of the method of applying a substrate to a moving web of material.

Looking now to FIGS. 1 and 2, the basic concept of the invention will be explained. As discussed briefly before, it is the main purpose of the invention to provide a backing for a fabric which allows the fabric to be readily handled and at the same time is relatively inexpensive. In the preferred form of the invention the fabric to be handled is a synthetic, tufted loop fabric which is cut to form a cut, pile fabric. Normally, the fabric has a hard permanent adhesive backing of latex, PVC or other suitable material applied thereto and heat set with the heat setting operation causing some heat setting of the synthetic fibers in the face of this fabric. To eliminate the use of the hard permanent adhesive backing before loop cutting, it is desired to provide a water paste solution to the back of the fabric and then freeze it. If desired, a thinner than normal hard back can be applied after cutting of the fiber loops to provide the cut loop fabric 10 shown in FIG. 2. This basically consists of providing a plurality of cut fibers 12 tufted into a suitable backing material 14 and held therein by the frozen water paste substrate 16. A layer 18 of back coating of latex, PVC or other suitable material may be applied, if desired.

Figure 2:
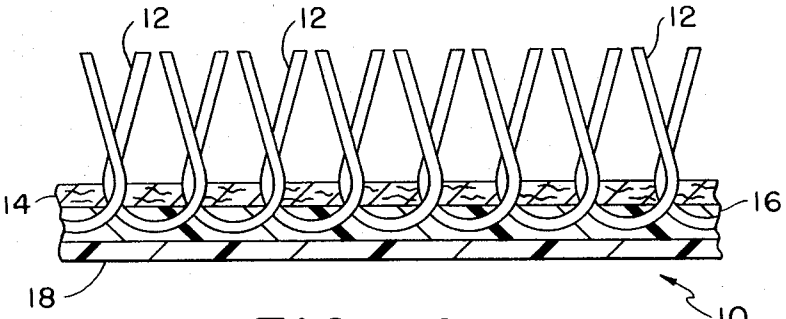
FIG. 2 is a cross-sectional schematic view of a tufted fabric having a substrate applied thereto.
Figure 3:
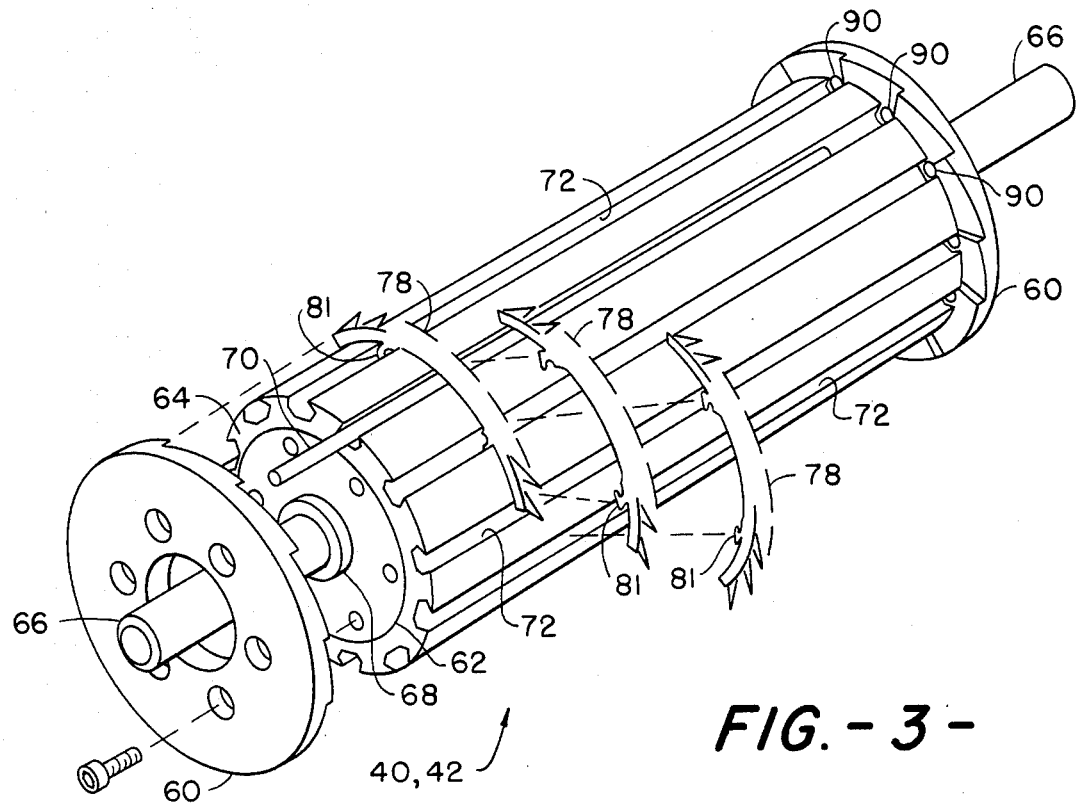
FIG. 3 is a perspective view of the cutting rotor employed in the system shown in FIG. 1.

To produce the fabric 10 shown in FIG. 2, the system of FIG. 1 is employed wherein the tufted substrate 19 of acrylic, polyester, nylon, etc., fibers tufted into a backing material of jute, polypropylene or other suitable material is supplied from a supply roll 20 by a pair of driven feed rolls 22 and 24. The substrate 19 is supplied through the tension control apparatus 26, consisting of a plurality of tension bars and spreader rolls, to the water paste applicator roll 28. The extruder 30, supplied from a manifold 32, supplies a water paste solution of approximately 98% water and 2% thickeners to the rotating roll 28 which in turn applies the solution to the back side of the tufted fabric 19. The thickener is preferably carboxy methyl cellulose to provide a water paste solution with a viscosity of approximately 20,000 centipoise. The fabric 19 is guided by roll 34 onto the chill roll or freezing drum 36 whereat the solution is frozen to form the layer 16 prior to rotation into contact with the rotary cutters 40 and 42 in the cutting zone. The chill roll or freezing drum 36 is maintained at a temperature of approximately −30° F. to accomplish the desired freezing.

After the layer 16 is frozen, the fabric 19 with the frozen substrate thereon is rotated past the cutting rotors 40 and 42 whereat the loops of the loop pile, tufted fabrics are cut to form the pile fibers 12. The cutters 40 and 42 can be of any suitable type such as that shown and disclosed in U.S. Pat. No. 4,117,577. From the cutters 40 and 42 the cut pile fabric is delivered to the back coating application roll 45 over idler roll 44. The application roll 45 is supplied a back coating solution of latex, PVC, etc. by an extruder 46 supplied by a manifold 48. The application roll 45 supplies the desired back coating layer 18 adjacent the frozen layer 16 to form the fabric 10 shown in FIG. 2. From the applicator roll 45 the fabric 10 is supplied over a plurality of guide rolls 50 and up into a heating chamber 52. In the heating chamber 52, the fabric 10 is guided over a plurality of hot cans 54 by the rolls 56 to melt the frozen layer 16 and cure the back coating layer 18 to the cut pile tufted fabric. From the heating chamber, the fabric is taken up by a take-up roll 58.

Figure 4:
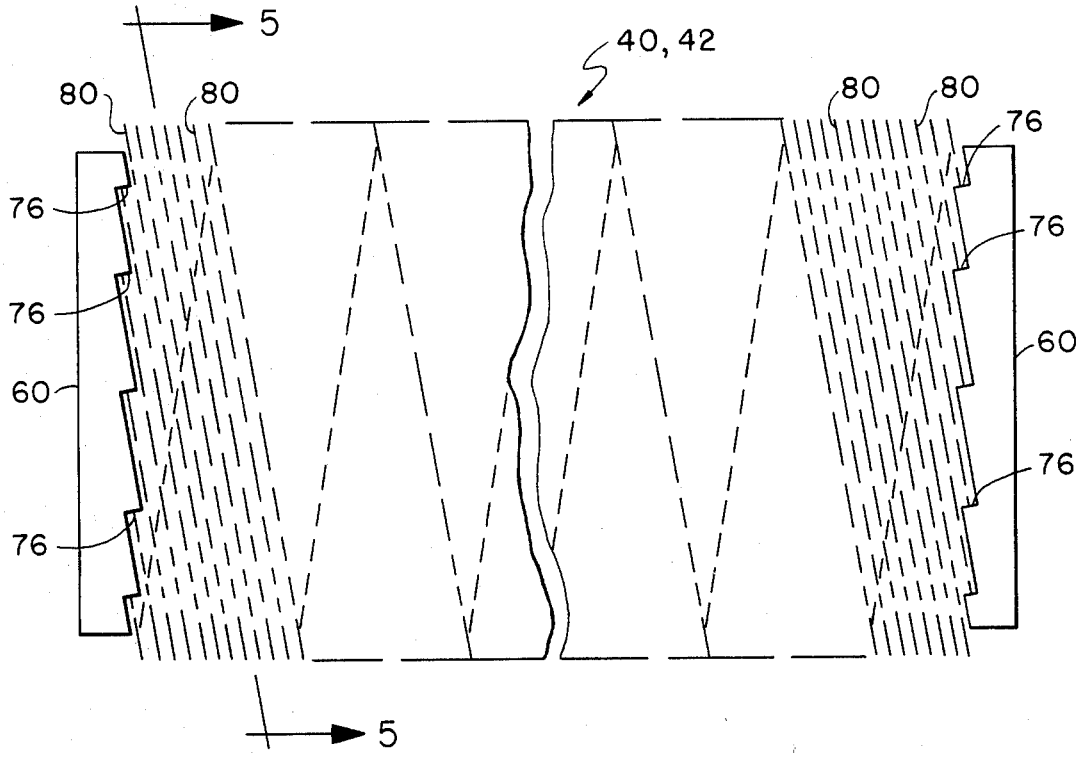
FIG. 4 is a schematic view of the rotor of FIG. 3 showing the location of the cutting blades.
Figure 5:
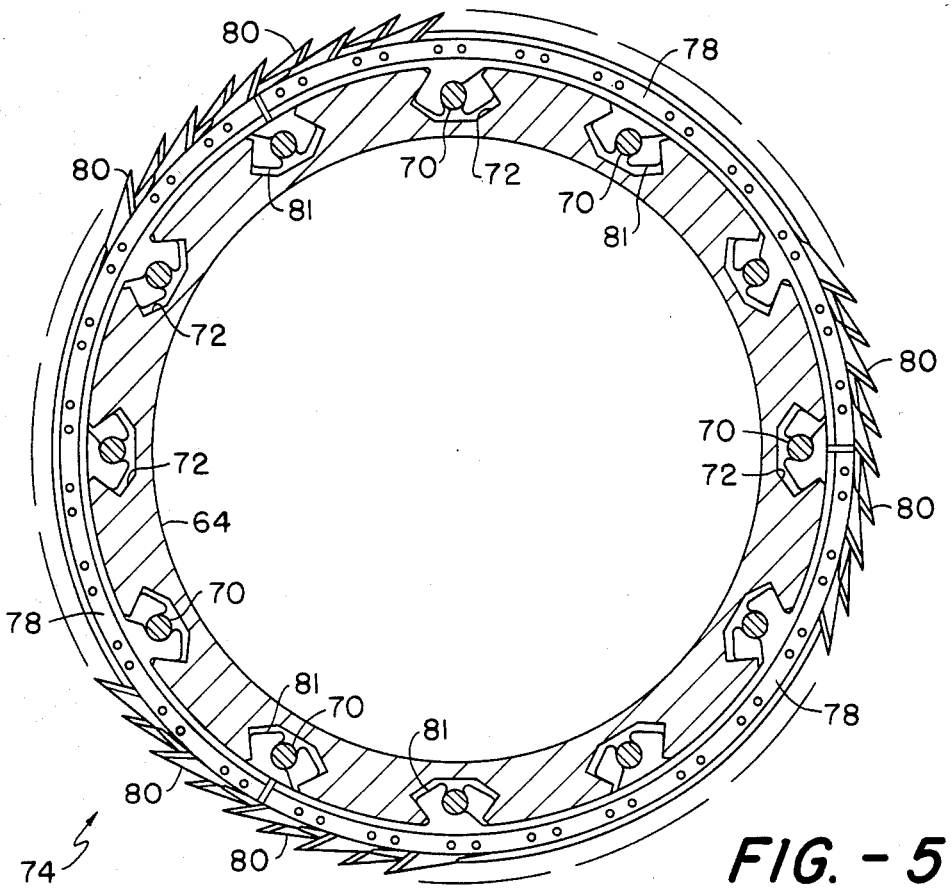
FIG. 5 is a section view taken on line 5—5 of FIG. 4 showing the interconnected blade segments.

Looking now to FIGS. 3–7, the rotary cutters 40 and 42, identical in design, are shown in detail. Each rotary cutter consists of a pair of end plates 60, a pair of hub plates 62 which form the end plates for the hollow rotor body 64 and support the rotor shaft 66 in bearings 68, rod members 70 located in grooves 72 cut in the surface of the rotor body 64 and a plurality of helical cutting members 74. The inside surface of each of the end plates 60 are serrated to provide an abutment surface 76 for one of the helical cutting members 74. In the preferred form of the invention, the number of helical cutting members is equivalent to the number of grooves 72 in the rotor body 64 and, as shown in FIG. 4, each helical cutting member makes a plurality of wraps around the rotors 40, 42.

Figure 6:
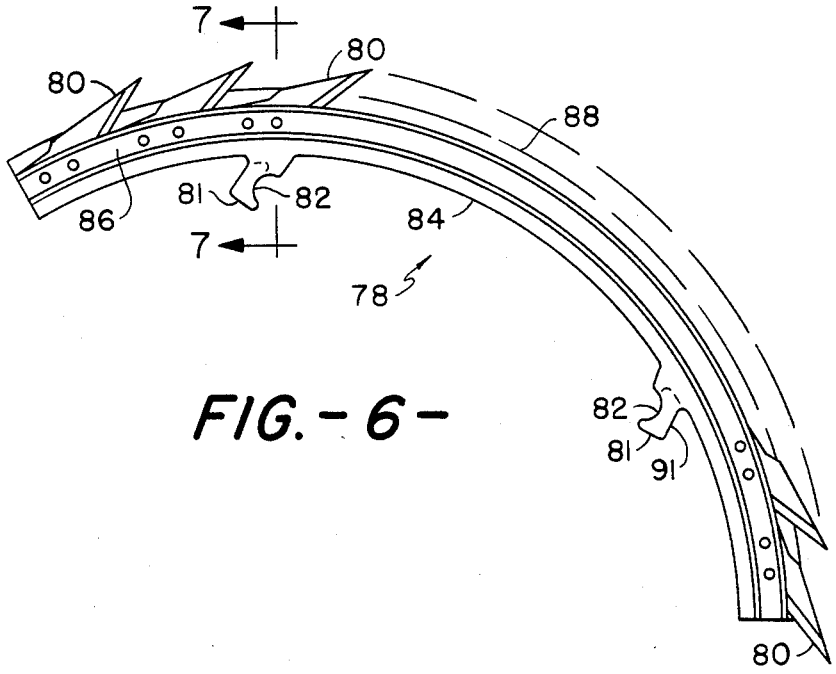
FIG. 6 is a side elevation view of one of the cutting blade segments.
Figure 7:
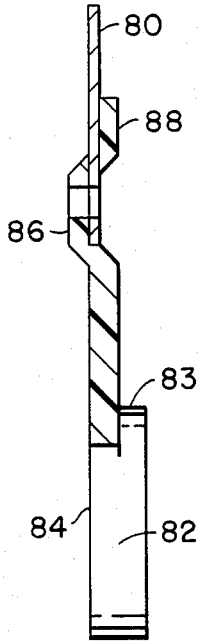
FIG. 7 is a section view taken on line 7—7 of FIG. 6.

Each complete revolution of the helix of the helical cutting members 74 is comprised of a plurality of cutting blade segments 78 as shown in FIG. 6. In the preferred embodiment of the invention, there are three equal cutting blade segments 78 for each 360° of each helical cutting element as clearly shown in FIG. 5. Each cutting blade segment is molded from a suitable plastic like material with the cutting blades 80 placed therein as an integral part of the segment during molding. Each blade segment has tongue or tab portions 81 extending downwardly therefrom with a concave surface 82 therein to engage the rod members 70 in the grooves and an extra thick portion 83 to abut the next adjacent segment in the next adjacent helical cutter member. Molded as an integral unit is the lower arcuate flange portion 84, the arcuate projecting locking portion 86 and the upper arcuate flange portion 88. The blades 80 abut the top of the lower flange portion and are held between the locking portion 86 and the upper flange 88.

In assembling the cutting rotors 40 and 42, the individual cutting blade segments 78 are placed in position by placing the tongue or tab portions into the grooves 72 of rotor body 64 in the desired manner and then, after all the segments 78 are located properly in the grooves 72, the locking rods 70 are inserted through the grooves 72 to engage the concave surfaces 82 of the respective blade segments to maintain the back surface 91 of each tongue portion 81 against the back of the respective groove 72 to prevent disengagement thereof during operation of the cutting rotor. As mentioned previously, the abutment surfaces 76 on the inside of the end plates maintain each helical cutter member 74 in a fixed position while openings 90 accommodate the backing rod members 70.

In the preferred embodiment of the invention, the tongues 81 and the cutting blades are so located that the tongues or tabs are 60° away from each other so that when adjacent blade segments are mounted one groove 72 away from each other in the peripheral direction of the rotor, the blades on one blade segment will be located halfway between the blades on the next adjacent segment. In other words, assuming three adjacent ring segments are mounted in sequential order on the rotor body, the blades of the first segment and the third segment will be in line longitudinally of the rotor axis while the blades on the second segment will be located between the blades on the first segment and the third segment.

As discussed above, the cutting rotor has a plurality of helical cutting members thereon. It has been found that when a fabric surface, such as the tufted pile fabric herein disclosed, is treated by a plurality of helical cutters that this eliminates the rowing effect in the fabric normally observed when the fabric has been cut by a cutting rotor having cylindrical cutters thereon. This new result provides a fabric which is more pleasing to the eye and has a better hand or feel.

Although the preferred embodiment of the invention has been described, it is contemplated that many changes may be made without departing from the scope or spirit of the invention and I desire to be limited only by the claims.

I claim:

1. A cutting rotor comprising: a cylindrical body member having a plurality of axial grooves in the surface thereof, a plurality of helical cutting members equal to the number of grooves in said body member surface secured to said body member and having tabs integral therewith which project into said grooves and making a plurality of 360° wraps around said cylindrical body member, each of said helical cutting members having at least three cutting segments in 360° wrap of said helical member and end caps mounted on both ends of cutting rotor to maintain said helical cutting members on said body member, each of said end caps being serrated on the inside thereof to provide a number of abutment surfaces equal in number to the number of helical cutting members, each helical cutting member abutting one of the abutment surfaces on the inside of each end cap.

2. The rotor of claim 1 each of the cutting segments has two tabs, each of said tabs having a concave surface with the concave surface on one tab facing the concave surface on the other tab and locking rods held between said tabs and passing through said grooves and engaging said concave surfaces.

3. The rotor of claim 1 wherein the cutting segments of adjacent helical cutting members are spaced one groove from one another so that the cutting blades on one helical cutting member is located between the cutting blades on the next adjacent helical cutting member.

4. The rotor of claim 3 each of the cutting segments has two tabs, each of said tabs having a concave surface with the concave surface on one tab facing the concave surface on the other tab and locking rods held between said tabs and passing through said grooves and engaging said concave surfaces.

* * * * *